US007328697B2

(12) United States Patent
Turner et al.

(10) Patent No.: US 7,328,697 B2
(45) Date of Patent: Feb. 12, 2008

(54) RADIANT TUBE HEATER ASSEMBLY

(75) Inventors: Glyn Wilfred Turner, Brierley Hill (GB); Lee Brian Herbert, Brierley Hill (GB)

(73) Assignee: Ambi-Rad Limited, West Midlands (GB)

( * ) Notice: Subject to any disclaimer, the term of this patent is extended or adjusted under 35 U.S.C. 154(b) by 0 days.

(21) Appl. No.: 10/534,060

(22) PCT Filed: Nov. 7, 2003

(86) PCT No.: PCT/GB03/04818

§ 371 (c)(1),
(2), (4) Date: Sep. 7, 2005

(87) PCT Pub. No.: WO2004/042282

PCT Pub. Date: May 21, 2004

(65) Prior Publication Data

US 2006/0081580 A1 Apr. 20, 2006

(30) Foreign Application Priority Data

Nov. 7, 2002 (GB) ..... 0226006.5

(51) Int. Cl.
*F23C 3/00* (2006.01)

(52) U.S. Cl. ..... 126/91 A; 126/91 R

(58) Field of Classification Search ..... 126/91 A, 126/91 R; 165/156, 163, 184
See application file for complete search history.

(56) References Cited

U.S. PATENT DOCUMENTS

| | | | | |
|---|---|---|---|---|
| 4,309,978 A | | 1/1982 | Henseik et al. | |
| 4,729,365 A | | 3/1988 | Mutchler | |
| 5,065,736 A | | 11/1991 | Mutchler | |
| 5,487,423 A | * | 1/1996 | Romero | 165/156 |
| 6,024,083 A | | 2/2000 | Smirnov | |
| 6,044,837 A | | 4/2000 | Tyler | |

FOREIGN PATENT DOCUMENTS

| | | | |
|---|---|---|---|
| EP | 1 217 294 A2 | | 6/2002 |
| FR | 2 609 157 A | | 7/1988 |
| GB | 925 365 A | | 5/1963 |
| GB | 2 144 843 A | | 3/1985 |
| JP | 58-085022 A | | 5/1983 |
| JP | 200146864 | * | 2/2001 |

OTHER PUBLICATIONS

WPI Abstract Accession No. 1985-145210[24], SU 1126776, Glebov et al., Nov. 30, 1984.

* cited by examiner

*Primary Examiner*—Alfred Basichas
(74) *Attorney, Agent, or Firm*—Buchanan Ingersoll & Rooney, PC

(57) ABSTRACT

An indirect heater assembly (10) comprises a radiant tube heater (12) and a fan (14) for generating an air flow over the heater (12). In an preferred embodiment and in another aspect, the radiant tube heater (12) comprises a radiant tube burner, an elongate tube 16 and a spiral tube (23) connected to the elongate tube (16) by a U-shaped tube (25). The spiral tube (23) extends around the elongate tube (16) coaxially thereof.

18 Claims, 6 Drawing Sheets

RADIANT TUBE HEATER ASSEMBLY

Figure 1:
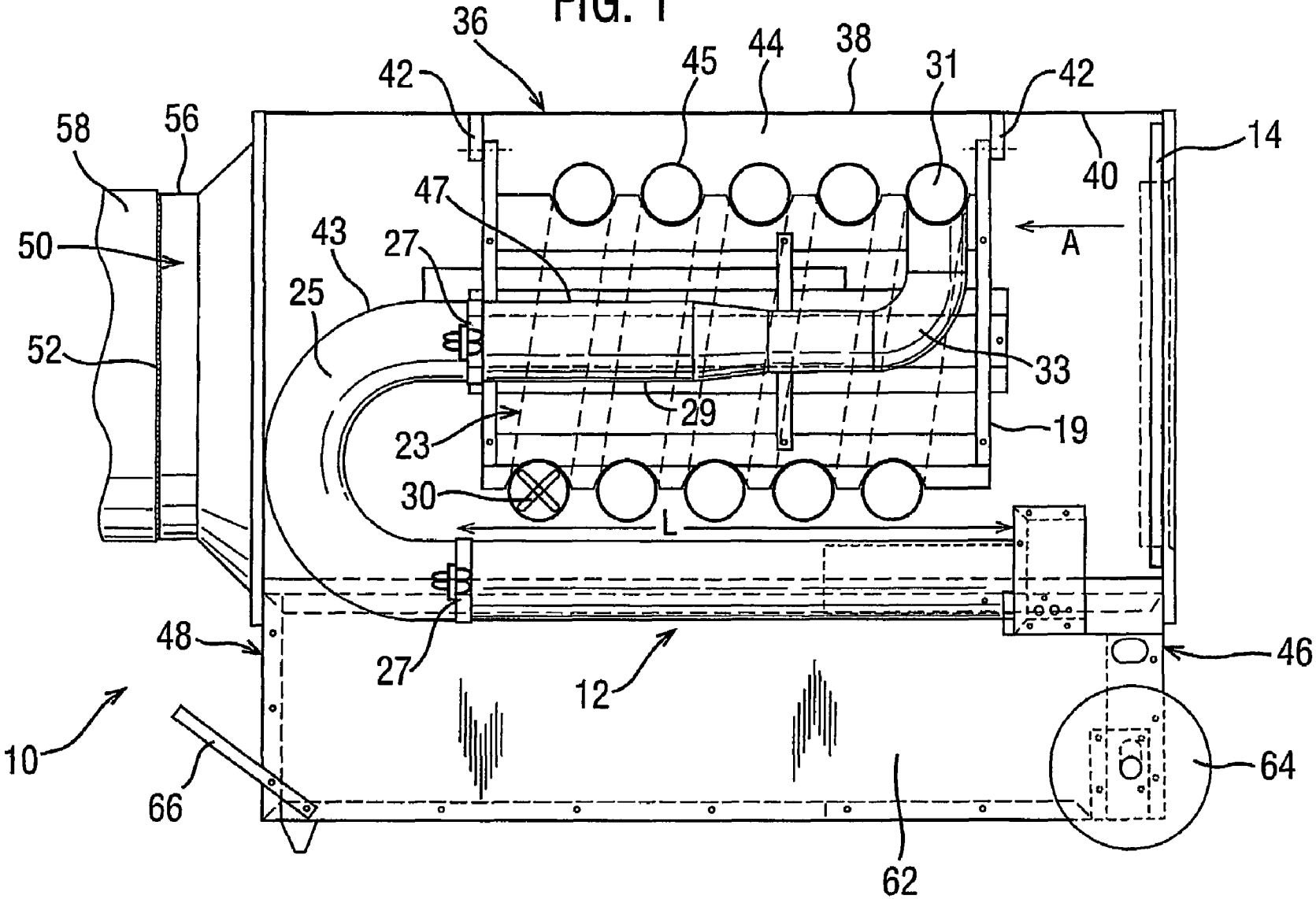

The present invention relates to a radiant tube heater assembly.

Radiant tube beaters are known, and comprise a burner tube located within a heater tube. A mixture of fuel and air is supplied to the burner tube where it is mixed, and emerges via a burner head where it is ignited so as to produce a flame inside the heater tube. The gas in the heater tube increases in temperature thereby creating a hot tube which radiates heat to the surroundings. The heater tube includes a fan located at one end which draws or blows air along the tube so as distribute hot air along the length of the tube.

Radiant tube heaters are often used in large volume installations where the tube is extended around the installation so that it radiates heat and heats up the surroundings.

One problem with this type of heater is that it is not particularly efficient for heating locally. For this purpose, conventional non-radiant type heaters are used which ignite fuel and air in an open tube so as to produce a flame and heat the surroundings. This type of heater suffers from safety issues such as having an exposed naked flame, and the fact that the combustion products such as carbon monoxide and dioxide are dangerous and cannot be controlled. Thus using exposed naked flame heaters is not always desirable, particularly where the environment has inadequate ventilation, or where occupants of the installation are situated near the heater.

What is needed, is a radiant tube heater which is more suited to heating locally, but avoids the safety problems of conventional non-radiant tube type heaters.

Thus according to the present invention there is provided a radiant tube heater assembly comprising a radiant tube heater, and air flow generating means arranged to generate an air flow over the radiant tube heater so as to provide convected heating.

Advantageously this provides a flow of hot air to the surrounding area which is more easily directed than radiant heat provided by conventional radiant tube heaters; and heats ambient air rather than surfaces.

Preferably the heater assembly is located within a housing. That prevents user contact with the hot radiant tube heater.

The housing preferably has a wall around the radiant tube heater so as to constrain the air flow over the tube heater, the wall defining an air flow pathway over the heater and an outlet to direct the hot air to the surroundings. That provides an enclosed area in which the air passes more closely over the heater thereby heating the air more efficiently. The outlet enables the hot air to be directed in a particular direction.

The housing may further include a heating duct which is connected to the outlet so as to direct hot air to a particular part of the surroundings.

In one embodiment the radiant tube heater comprises an elongate tube. Typically the elongate tube is made from stainless steel to withstand the high temperatures in the tube. In another embodiment the radiant tube heater assembly comprises a spiral tube provided at an end of the radiant tube heater. The spiral tube preferably comprises a straight portion and a spiral portion downstream of the straight portion and arranged around the straight portion, most preferably substantially coaxially around the straight portion.

This provides several advantages. Firstly more surface area of heater tube is provided for a given overall heater assembly length, thereby producing more efficient heating of air. Secondly, since the spiral portion is arranged around the straight portion, air inside the spiral portion is heated by heat radiating from the straight portion of the spiral tube, and thus air passing over the spiral portion is heated more efficiently.

The radiant tube heater is preferably connected to the straight portion of the spiral tube by a U-shaped tube. The U-shaped tube enables the heater and the spiral tube to be housed in a compact manner. Also, the burner can be held remote from the airflow over the spiral tube which improves performance.

The spiral portion is made from a flexible material to enable it to be wrapped around the straight portion.

The straight portion may be connected to the spiral portion by an elbow.

Air flow generating means preferably comprises an impeller to draw air over the radiant heater tube or to blow air over the radiant heater tube. The air flow generating means may be located on the assembly or on the housing.

The elbow between the spiral portion and the straight portion is preferably positioned near the air flow generating means. Thus the elbow remains sufficiently cool to prevent damage to the material which is typically not as heat resistant as the stainless steel tube.

Preferably the assembly includes an exhaust duct located in fluid communication with the heater tube so as to direct gaseous combustion products away from the surrounding environment. More preferably the exhaust duct is located at an open end of the heater tube. This means that the exhausted gas is cooler, and avoids exhausting hot gas from the tube which could otherwise be used to heat up the air flow over the tube. Including an exhaust duct is particularly suitable for use with a heater with a spiral tube, since the hot gas has travelled further along the tube, and is consequently cooler.

The housing can include wheels located at one or both ends, to enable it to be easily transported within a working environment to wherever heat is required. The use of a spiral tube enables a more compact heater to be created, and thus makes it easier to transport.

In a preferred form of radiant tube heater a mesh burner head is provided. Compared to known burner heads, the mesh provides a shorter flame, and thus enables shorter tubes to be used without the end of the tube being impinged by the flame.

Whilst generating a flow of air over a radiant tube heater provides a more effective means of heating surroundings, there are some situations where a radiant tube heater is still desirable For example, in a dusty environment, a flow of hot air is not particularly welcome. However, known radiant tube heaters either do not produce a sufficient quantity of radiant heat, or to produce enough heat, require a longer tube to increase the surface area from which heat can radiate. Even when a longer tube is used, the gas inside the tube becomes progressively cooler as it travels through the tube, and thus an insufficient quantity of heat can be produced.

Another object of the present invention is to provide an improved radiant tube heater.

According to a second aspect of the present invention there is provided a radiant tube heater, the heater having a heater tube, the tube having a straight portion and a spiral portion arranged around the straight portion.

The above arrangement provides several advantages. Firstly, more surface area of heater tube is provided for a given length of radiant tube heater, thereby producing an increased surface area to radiate heat. Secondly, since the spiral portion is around the straight portion, air inside the spiral portion of the tube is heated by heat radiating from the straight portion of the heater tube.

Most preferably, the spiral portion is arranged substantially co-axially around the straight portion. That means that the spiral portion is heated substantially uniformly by the straight portion.

Several of the preferred features of the first aspect of the invention equally apply to the second aspect of the invention.

Preferably the assembly includes an exhaust duct located in fluid communication with the heater tube so as to direct gaseous combustion products away from the surrounding environment. More preferably the exhaust duct is located at an open end of the heater tube. This means that the exhausted gas is cooler, and avoids exhausting hot gas from the tube which would otherwise radiate to the surroundings. Including an exhaust duct is particularly suitable for use with a heater with a spiral tube, since the hot gas has travelled further along the tube, and is consequently cooler.

The heater can include means, for example wheels located at one or both ends, to enable it to be easily transported within a working environment to wherever heat is required. Again, the use of a spiral portion in the tube enables a more compact heater to be created, and thus makes it easier to transport.

In a preferred form of radiant tube heater a mesh burner head is provided. Compared to known burner heads, the mesh provides a shorter flame, and thus enables shorter tubes to be used without the end of the tube being impinged by the flame.

Figure 2:
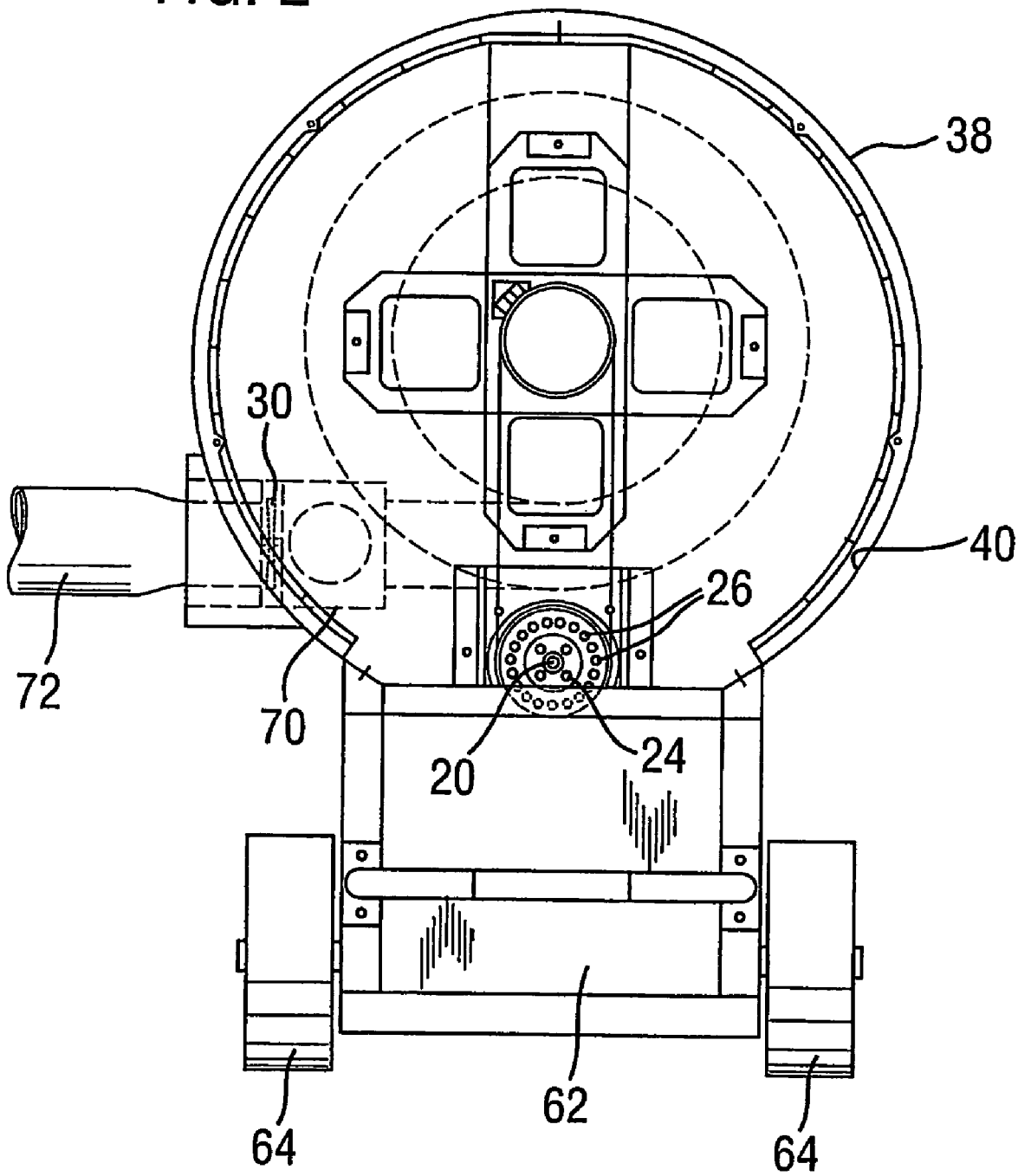
Figure 3:
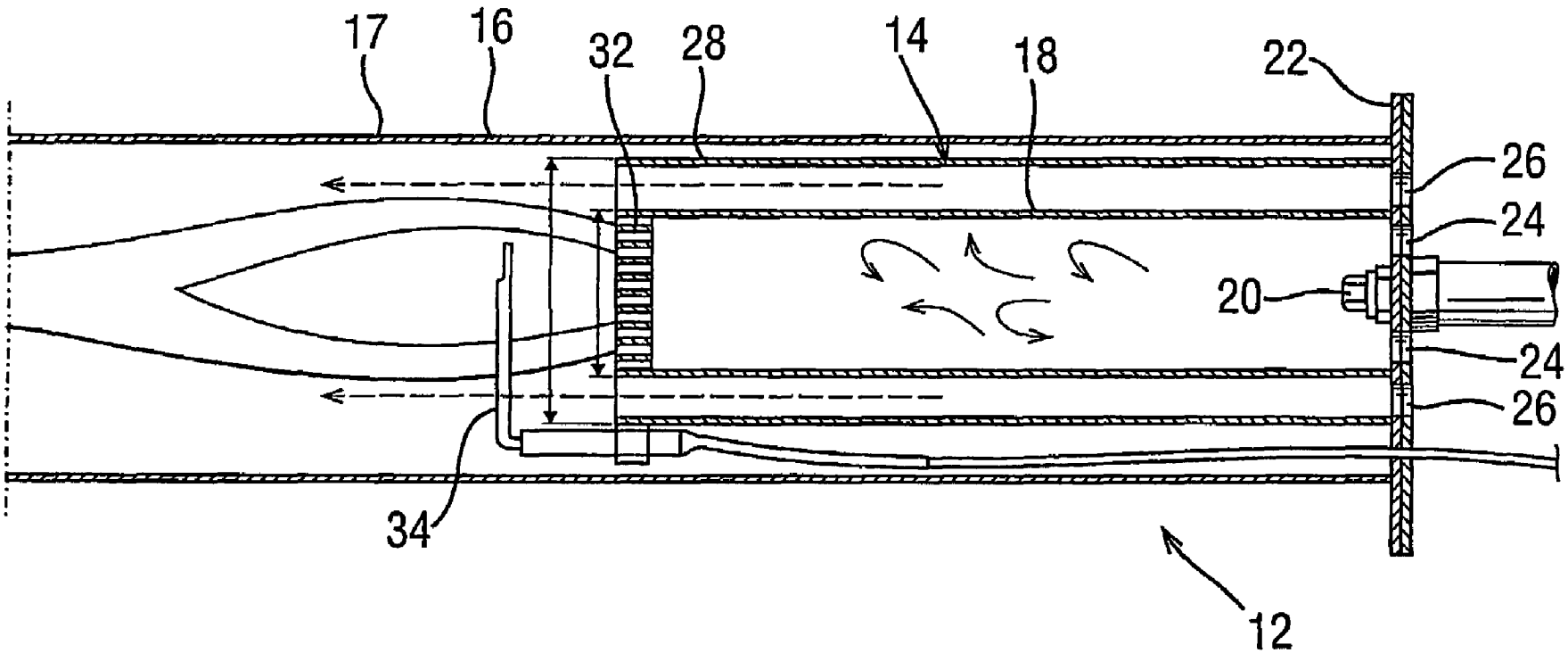
Figure 4:
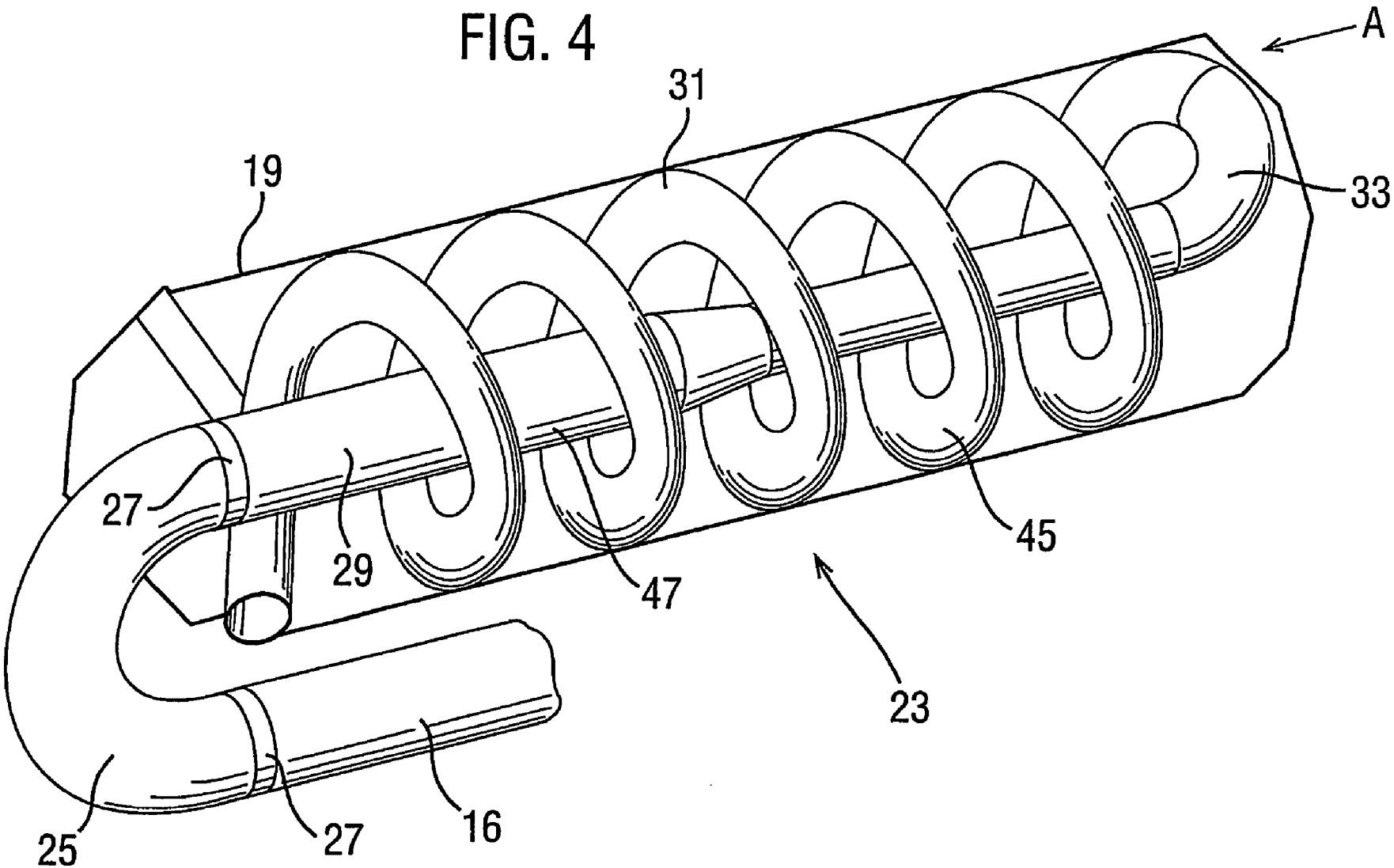
Figure 5:
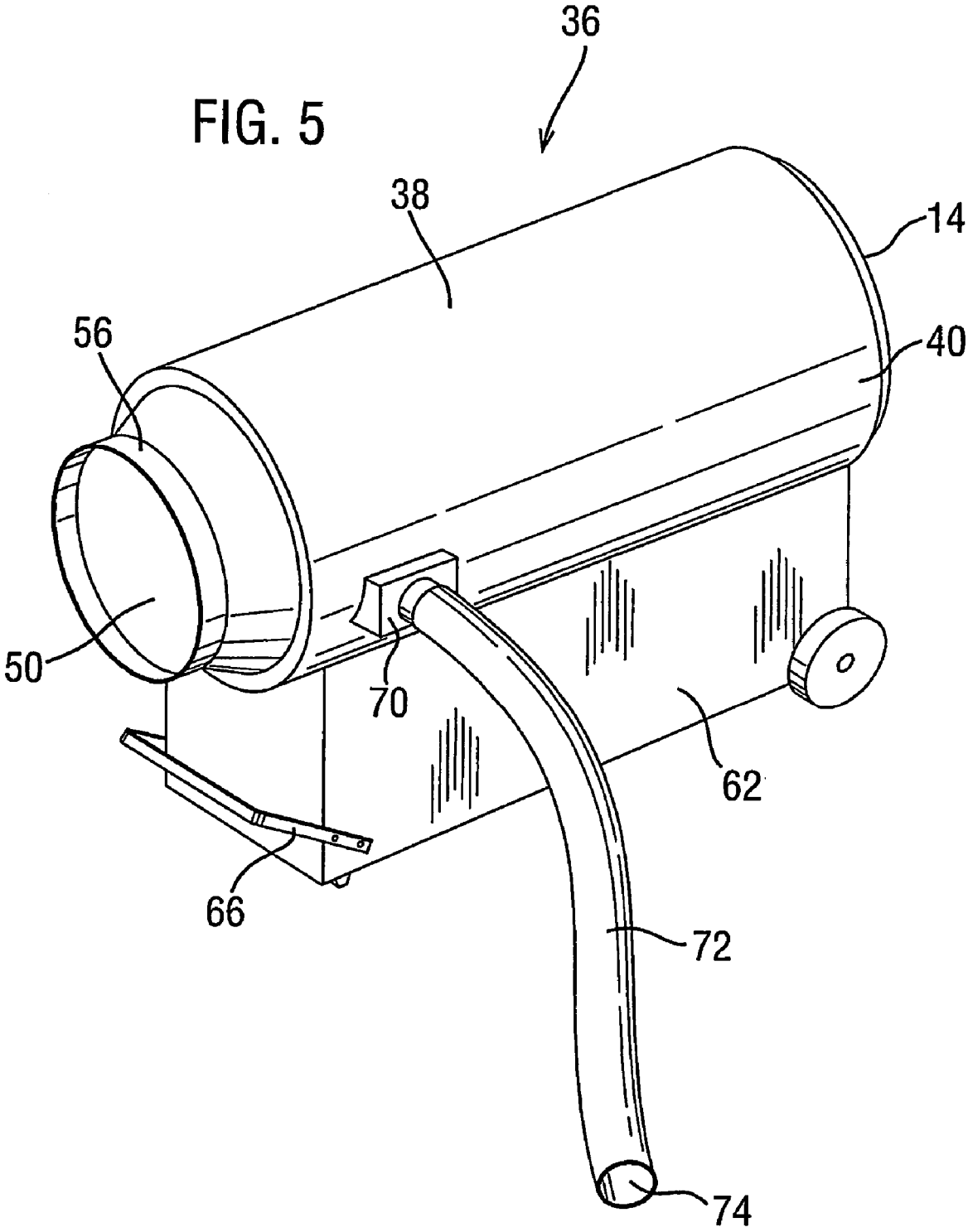
Figure 6:
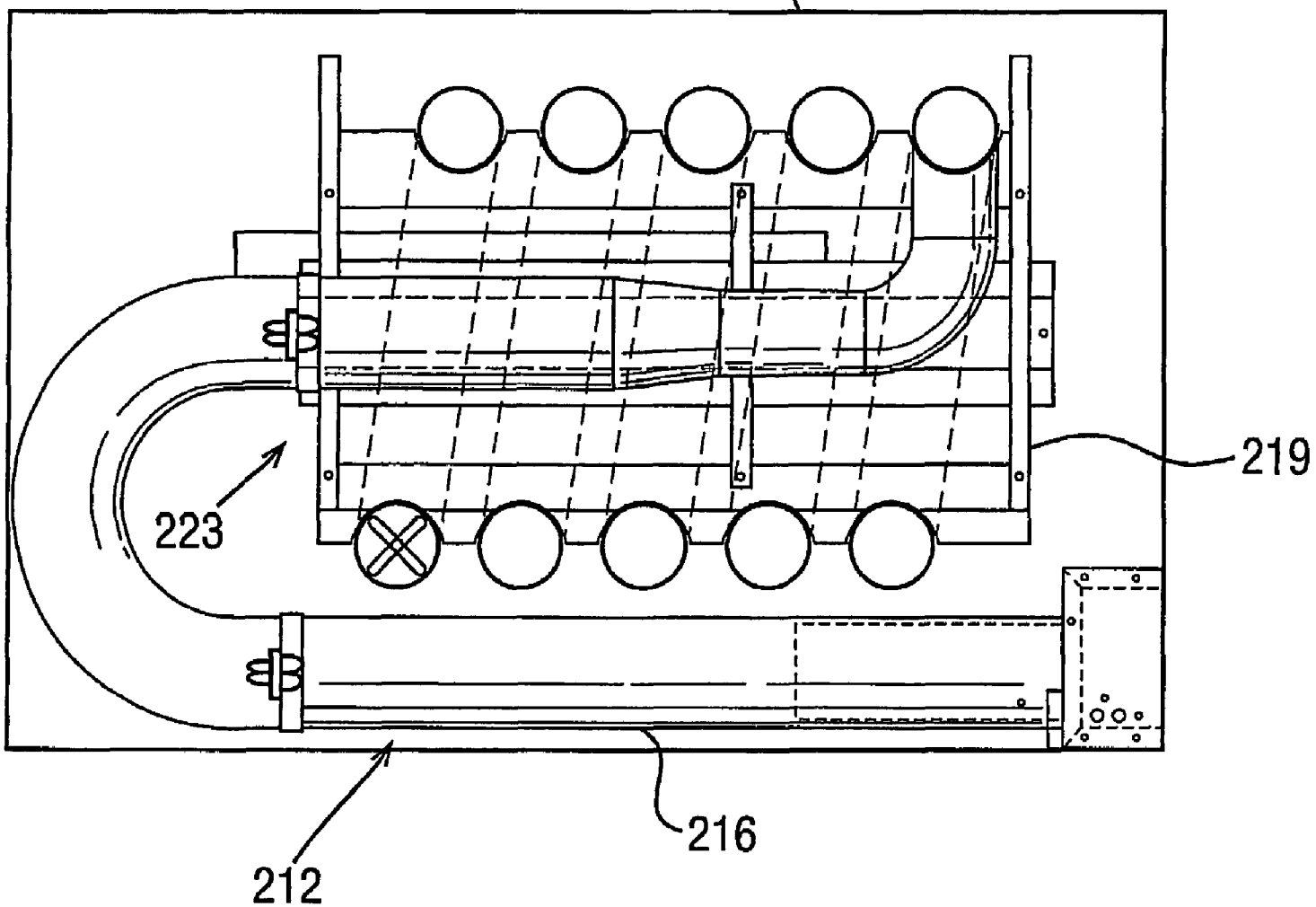

The invention will now be described by way of example only with reference to the accompanying drawings in which:

FIG. 1 is a side view of a radiant tube heater assembly according to the first and second aspects of the present invention, FIG. 2 is an end view of the radiant tube heater assembly of FIG. 1, FIG. 3 is a side cross-sectional view of a known radiant tube heater, FIG. 4 is a perspective view of part of the radiant tube heater assembly of FIG. 1, FIG. 5 is a perspective view of the radiant tube heater assembly of FIG. 1 located within a housing, and FIG. 6 is a side view of a radiant tube heater according to a second aspect of the present invention.

In FIGS. 1 to 5, a radiant tube heater assembly 10 comprises a radiant tube heater 12 and air forcing means in the form of a fan 14.

One example of a radiant tube heater is that described in our co-pending European patent application EP1217294. The radiant tube heater 12 (FIG. 3) comprises a radiant tube burner 14 arranged substantially co-axially within an elongate tube 16. The tube 16 has an external surface 17. Fuel is supplied to a mixing tube 18 via a nozzle 20 which is connected to a fuel supply (not shown).

The heater 12 has an orifice plate 22 which includes primary air inlet means in the form of a first set of holes 24 to supply substantially turbulent air to the mixing tube 18, and a secondary air inlet means in the form of a second set of holes 26 to supply substantially non-turbulent air to a second tube 28, the second tube arranged around the mixing tube and having a larger diameter. Air is supplied under pressure by drawing air using an impeller 30 located downstream of the burner. Alternatively air could be supplied by blowing air using a fan upstream of the orifice plate 22. Air and fuel entering the mixing tube 18 is mixed upstream of a burner head 32 due to the turbulent air flow. The air/fuel mix emerges from the burner head 32 and is ignited by an ignition device 34 to produce a flame. The substantially non-turbulent air emerging from the second tube 28 promotes the long flame shown in FIG. 3. Thus the tube 16 contains hot gas. To withstand the temperatures of the hot gas, the tube is made from a suitable heat resistant material, for example, stainless steel. Typically the diameter of the tube is 100 mm (four inches).

The assembly includes a spiral tube 23 (FIG. 4) which is connected to the elongate tube 16 by a U-shaped tube 25. A fitting 27, which is gas tight, connects the elongate tube 16 to one end of the U-shaped tube 25. The U-shaped portion has a surface 43.

The spiral tube has an straight portion 29 and a spiral portion 31. The U-shaped tube 25 is connected to one end of the straight portion by a similar gas tight fitting 27. The other end of the straight portion 29 is connected to the spiral portion by an elbow 33. The spiral portion has a surface 45 and the straight portion has a surface 47. The elongate tube 16 has a length L which is sufficient to contain the flame generated by the burner and prevent the flame from impinging on the U-shaped tube. Typically the straight and spiral portions are 75 mm (3 inches) in diameter.

The spiral portion 31 is made from a flexible material to enable it to be wrapped around the straight portion 29. No combustion takes place inside the spiral portion 31 and therefore use of high temperature resistant materials such as steel is not necessary.

The spiral tube is mounted onto a frame 19, and the frame 19 is housed within a housing 36. The housing has an elongate hollow cylindrical portion 38 with an outer wall 40, and annular flanges 42 extending therefrom. The frame 19 is secured to the annular flanges 42 such that the spiral tube 23 and the cylindrical portion of the housing are substantially coaxial, and an enclosed space 44 is created between the heater 12 and the housing wall 40.

The fan 14 is positioned at and fixed to an air inlet end 46 of the housing via suitable fixings (not shown). The fan has a diameter which is slightly smaller than diameter of the cylindrical portion of the housing. The fan 14 can be electrically powered, or pneumatically powered where it is possible to utilise the air supply used to supply air to the mixing tube. It will be appreciated that the fan 14 is positioned near the elbow 33 which connects the spiral and straight portions of the spiral tube and thus the elbow is kept sufficiently cool thereby enabling the use of a material of lower heat resistance.

An air outlet end 48 of the housing has an air outlet in the form of an aperture 50 which is covered by a grill 52. The housing has a cylindrical lip 56 extending therefrom. A heating duct 58 is positionable on the lip 56 so as to direct hot air emerging from the outlet into the surroundings from its open end (not shown). Alternatively the hot air can enter the surroundings from the aperture 50 without the need for a heating duct.

The housing has a rectangular base portion 62, onto which wheels 64 locate at one end. A handle 66 is positioned on the base portion at the opposite end. The housing can be manoeuvred using the handle and the wheels and transported to different locations. In other embodiments the housing may be fixed and not require wheels.

The open end of the spiral portion 31 is connected to an exhaust outlet 70 (see FIG. 2) mounted on the outer wall 40 of the housing so as to direct gaseous combustion product from the tube. An exhaust tube 72 (FIG. 5) is releasably connected to the exhaust outlet 70, and positioned such that its open end 74 is remote from the surrounding environment, for example; outside of the working environment. The impeller 30 is located within the spiral portion at its open end and acts to draw hot gas through the heater tube 16. Thus gas in the hot tube passes from the heater tube 16 into the spiral tube via the U-shaped tube, and into the exhaust tube 72 before exiting at its open end 74. Having an exhaust tube which is releasably connected to the housing is advantageous where the housing is mobile and the exhaust tube is fixed to the surroundings, for example to an outlet in an exterior wall.

In operation, fuel and air is supplied to the mixing tube 18 and ignited so as to produce hot gas in the tube 16. The impeller 30 draws hot gas through tube 16 and through the straight and spiral portions of the spiral tube, such that surfaces 17,45,47 become hot. With the fan operating, air flows in the direction of A into the enclosed space 44, over the hot surfaces 17,45,47 and is heated. The hot air passes over the heater due to the blowing action of the fan until it exits the housing via the outlet 50. The hot air enters the surroundings directly from the housing outlet, or where a heating duct is fitted, passes through the heating duct where it enters the surroundings at the open end of the duct. Gaseous product from the tube 16 is exhausted via exhaust tube 72.

It will be appreciated that air passing over the heater is heated in three ways; by conduction of air adjacent the surfaces 17,45,47, by convection within the enclosed space 44 as a result of the displacement of cold air which is adjacent the hot air, and by interaction with radiated heat from the surfaces 17,45,47.

In the embodiment of FIG. 1, air is blown over the heater by a fan positioned at one end of the housing. In another embodiment air could be drawn over the heater by an impeller located at the opposite end of the housing.

The embodiment of FIG. 1 uses a known type of burner head. An alternative burner head uses a mesh type material which locates at the end of the mixing tube. The mesh type material interacts with the fuel/air passing through, such that on ignition, a shorter flame is produced than with conventional burner heads. This enables a shorter tube to be used without impinging on the tube, and therefore a more compact heater assembly.

The embodiment of FIG. 1 relates to a particular example of a radiant tube heater. It will be appreciated that the present invention can be used with other radiant tube heaters.

The embodiment of FIG. 1 also houses the heater within a housing. In other embodiments it is possible to mount the fan onto the assembly and blow hot air over the heater without the need for a housing. However operation in this way is not as efficient since firstly there is no enclosed space to heat the air, and secondly there is no defined heat outlet to direct the hot air.

In an alternative embodiment, the radiant tube heater assembly need not include the spiral tube extending from the heater tube. In such an embodiment, air would be drawn down the tube by an impeller located at the end of the tube as opposed to the end of the spiral portion. The exhaust tube would also be located at the end of the tube.

Operation of such an alternative assembly would be similar to the embodiment of FIG. 1, except in this alternative embodiment the air flow comes into contact with a smaller tube surface area since there is no spiral tube. Thus to achieve the same heat output it would be necessary to make the tube of considerable length so as to increase the tube surface area, which would not be appropriate for a mobile heater. Furthermore, the spiral tube of the tube of the embodiment of FIG. 1 is also heated by heat radiating from the straight tube, which would not be the case if only an elongate tube were used. Such an arrangement is appropriate where a lower heat output is required.

In FIG. 6 a radiant tube heater 112 has features similar to the embodiment of FIG. 1 numbered 100 greater.

The heater 212 includes a radiant heater tube 216 as shown in FIG. 1, with a spiral tube 223 which extends from the tube. The heater 212 is mounted onto a frame 219, but in contrast to the embodiment of FIG. 1, the frame is not housed within a housing.

In contrast to the embodiment of FIG. 1, no air flows over the tube. Thus hot gas inside the tubes heats the surroundings by radiating from the tubes and not by the heating of air flowing over the tubes.

The housing of FIG. 1 would not be appropriate for this type of heater, as it would form a barrier against heat radiating from the tubes. However, some form of housing, for example a cage 290 could be used to prevent contact with the hot tubes and also allow heat radiating from the tubes to enter the surroundings unhindered.

As in the embodiment of FIG. 1, the heater includes an exhaust tube at the open end of the spiral portion 212 of the heater tube 216 so as to direct gaseous combustion products away from the surrounding environment.

This spiral radiant tube heater is advantageous over conventional elongate radiant tube heaters since the spiral portion provides a greater surface area of tube, thereby enabling a more compact heater to be produced. Furthermore, the spiral portion enables cooler gas to be extracted by the exhaust tubes creating a more efficient heating process.

It will be appreciated that the features described in relation to the embodiments of FIG. 1 can be included in this embodiment, and hence the heater can include wheels to enable it to be transported, and an alternative mesh burner head to generate a smaller flame within the tube. The spiral tube can also be included with other known radiant tube heaters.

The invention claimed is:

1. A heater assembly comprising:

a radiant tube heater, a spiral tube assembly, and air flow generating means, wherein the radiant tube heater comprises an elongate tube and a burner within said elongate tube, wherein a fuel is combusted with air and the hot combustion products flow in a single axial direction along said elongate tube and then through said spiral tube assembly;

wherein the spiral tube assembly comprises a straight portion and a spiral portion, the spiral portion being downstream of the straight portion and helically wrapped around the straight portion such that the hot combustion products pass first through said straight portion and then through said spiral portion; and wherein said air flow generating means is arranged to generate an air flow over both the radiant tube heater and the spiral tube assembly, thereby providing a hot air output stream from the heater assembly.

2. A heater assembly according to claim 1, wherein the heater assembly is located within a housing.

3. A heater assembly according to claim 2, wherein the housing has a wall around the radiant tube heater so as to constrain the airflow over the radiant tube heater, the wall defining an air flow pathway over the radiant tube heater and an outlet to direct the hot air to the surroundings.

4. A heater assembly according to claim 3, wherein the housing further includes a heating duct which is connected to the outlet so as to direct hot air to a particular part of the surroundings.

5. A heater assembly according to claim 1, wherein the radiant tube heater comprises an elongate tube.

6. A heater assembly according to claim 1, wherein the spiral portion is arranged coaxially around the straight portion.

7. A heater assembly according to claim 1, wherein the radiant tube heater is connected to the straight portion of the spiral tube by a U-shaped tube.

8. A heater assembly according to claim 1, wherein the spiral portion is made from a flexible material to enable it to be wrapped around the straight portion.

9. A heater assembly according to claim 1, wherein the straight portion is connected to the spiral portion by a suitable joint to provide an airtight seal.

10. A heater assembly according to claim 1, wherein the straight portion is connected directly to the spiral portion with no need for a joint, thereby reducing the number of parts.

11. A heater assembly according to claim 1, wherein the air flow generating means comprises an impeller to draw air over the radiant heater tube or to blow air over the radiant heater tube.

12. A heater assembly according to claim 1, wherein the air flow generating means is located close to the connection between the spiral portion and the straight portion so as to cool the connection in use.

13. A heater assembly according to claim 1, wherein the assembly includes means for removing the products of combustion from the heater tube.

14. A heater assembly according to claim 13, wherein the removing means includes an exhaust duct located in fluid communication with the heater tube so as to direct gaseous combustion products away from the surrounding environment.

15. A heater assembly according to claim 14, wherein the exhaust duct is located at an open end of the heater tube.

16. A heater assembly according to claim 2, wherein the housing includes wheels located at one or bath ends.

17. A heater assembly according to claim 1, wherein the radiant tube heater has a mesh burner head.

18. A heater assembly according to claim 1, wherein the assembly includes a fresh air inlet duct which supplies air to the radiant tube heater.

* * * * *